US005667174A

United States Patent [19]

Adams

[11] Patent Number: 5,667,174

[45] Date of Patent: Sep. 16, 1997

[54] DECORATIVE LIGHT STAKE

[75] Inventor: William E. Adams, Portersville, Pa.

[73] Assignee: Adams Mfg. Corp., Portersville, Pa.

[21] Appl. No.: 372,237

[22] Filed: Jan. 13, 1995

[51] Int. Cl.[6] ..... A45F 3/44

[52] U.S. Cl. ..... 248/156; 362/431

[58] Field of Search ..... 248/156, 508, 248/545, 512; 362/431, 391, 249, 806; 403/389

[56] References Cited

U.S. PATENT DOCUMENTS

| | | | |
|---|---|---|---|
| 301,083 | 1/1884 | Bornstein . | |
| 441,429 | 11/1890 | Mahin . | |
| 1,625,303 | 4/1927 | Fenton . | |
| 1,895,656 | 1/1933 | Gadke . | |
| 2,578,182 | 12/1951 | Fricano . | |
| 2,599,303 | 6/1952 | Ward . | |
| 2,751,174 | 6/1956 | Parker | 248/545 X |
| 2,976,000 | 3/1961 | Gunderson | 248/156 |
| 3,182,944 | 5/1965 | Laviano . | |
| 4,392,191 | 7/1983 | White, Sr. | 362/392 |
| 5,060,961 | 10/1991 | Bontrager | 403/389 X |
| 5,340,065 | 8/1994 | Thomas | 248/156 X |
| 5,437,449 | 8/1995 | Zink | 248/156 X |
| 5,496,005 | 3/1996 | Dieringer | 248/74.2 |

*Primary Examiner*—Ramon O. Ramirez
*Attorney, Agent, or Firm*—Buchanan Ingersoll, P.C.

[57] ABSTRACT

A light stake for holding decorative lights has a generally S-shaped or script C-shaped light holder releasably or permanently attached to a stake. The mounting clip is formed from a resilient material. The light holder will hold light sockets of the three popular sizes of Christmas lights. Display holders displaying decorative figures and reflectors can be positioned on the light stake.

19 Claims, 3 Drawing Sheets

DECORATIVE LIGHT STAKE

FIELD OF THE INVENTION

This invention relates to stakes for displaying decorative lights and particularly strings of Christmas lights.

DESCRIPTION OF THE PRIOR ART

The use of lights for decorating the exterior of a house is well known. Decorative lights typically consist of a large number of light sockets being wired together with light bulbs positioned in the light sockets. The string of lights is then attached to the face of a building, wrapped around a tree or hung on a seasonal display. The string of lights can be mounted by retaining either the light socket or the wire. The object of these holders is to display the lights so that they can easily be seen. The holders must not be adversely affected by cold temperatures and should be able to hold the lights during high winds which commonly accompany winter storms. Occasionally, the string of lights is strung on poles, usually by tying the wire to the poles so that there are several lights between poles.

Most prior art light mountings which grasp light sockets only accept one size light. However, there are three sizes of outdoor lights which are commonly displayed. Because the prior art mountings accept only one size light an entire new mounting would be necessary if a different size light is to be displayed.

In my U.S. Pat. No. Des. 331,360 I disclose a hook for supporting Christmas lights adjacent roofing shingles. This hook is comprised of a small stake which fits between the shingles having a single spiral at one end. The spiral end is sized to hold the wire of the Christmas light string, not a bulb or socket. Similar devices comprised of a stake or straight pin with a curved holder attached at one end have been used to retain other structures or products. Mahin in U.S. Pat. No. 441,429 discloses such a structure for use as a hanger for mounting gutters. Bornstein in U.S. Pat. No. 301,083 and Fenton in U.S. Pat. No. 1,625,303 disclose pins for holding price cards or securing upholstered parts of automobiles. A skewer having this basic shape is taught by Fricano in U.S. Pat. No. 2,578,182. None of these devices are suitable for holding Christmas lights.

One type of conventional, permanent light mounting is a two-piece rigid configuration comprising a base portion and a light socket retainer. The base portion is in the form of an L-shaped configuration. One leg of the L-shape base portion is permanently mounted to a relatively flat surface of a house such as a window frame. The other leg of the L-shape is a channel member having flanges on opposite sides which accommodate the light socket retainer. The light socket retainer slides into the channel member. The light socket retainer has two resilient clamp members which grasp a light. This type of light mounting is described in U.S. Pat. No. 3,540,687.

Another prior art device provides an L-shaped light support bracket with one of the legs being fitted under a shingle. The other leg includes a hole sized to receive a light bulb. This type of light support bracket can also be positioned within a retaining strip which is permanently attached to a flat building surface. Examples of these light mountings are shown in U.S. Pat. Nos. 4,905,131; 4,901,212; and 4,851,977; and has been sold under the trademark "LITES UP" by Gary Products Group, Inc. This type of mounting is easy to dislodge and frequently will come loose during winter storms.

Other related prior art devices are used for mounting electric lights on Christmas trees. One such device comprises a spring-biased H-shaped clip having a cylindrical light socket attached to the top of the clip. Multiple clips are connected together by insulated electrical wire. A light bulb is placed in each of the light sockets and the string of electrical wire is positioned on a Christmas tree wherein each clip attaches a light to a branch of the Christmas tree.

Another device for mounting light bulbs to Christmas trees provides a resilient clamp which grips the light bulb and spring fingers extending perpendicularly from the resilient clamp which grasps a tree limb. Examples of light mountings for attaching lights to Christmas tree branches are illustrated in U.S. Pat. Nos. 2,782,296 and 1,895,656. This type of mounting is relatively expensive and difficult to make.

All of the prior art mentioned do not provide a light mounting having a light holder which releasably or permanently holds the light sockets with the ability to retain various size light sockets. Such light holders also cannot easily be attached to stakes.

There is a need for an inexpensive stake-like nonpermanent holder for retaining various size outdoor lights which will securely retain the lights when subjected to winter storms.

SUMMARY OF THE INVENTION

I provide a light stake which holds all of the three commonly available strings of Christmas lights. The light stake comprises a preferably plastic T-shaped or rod-shaped body or stake one end of which is driven into the ground or inserted into a pre-drilled hole. An S-shaped or script C-shaped light holder is attached to the opposite end of the body. The light holder is flexible and sized to retain all common sizes of decorative lights. The light holder and the rod shaped body can be molded to form a one-piece construction.

I prefer to mold the light stake as one piece, but it can be molded as two pieces, one of which is snap fitted onto the other piece. If desired and to enable the product to be sold in a smaller package, the stake also can be made in two pieces which fit together. I also prefer to provide nodules within the S-shaped or C-shaped holder which engage the light socket to more securely retain the light.

Additional details, objects and advantages of the invention will become more readily apparent as the following description of certain present preferred embodiments thereof proceed.

BRIEF DESCRIPTION OF THE DRAWINGS

The accompanied drawings show presently preferred embodiments of my light stake in which.

DETAILED DESCRIPTION OF THE PREFERRED EMBODIMENT

Figure 1:
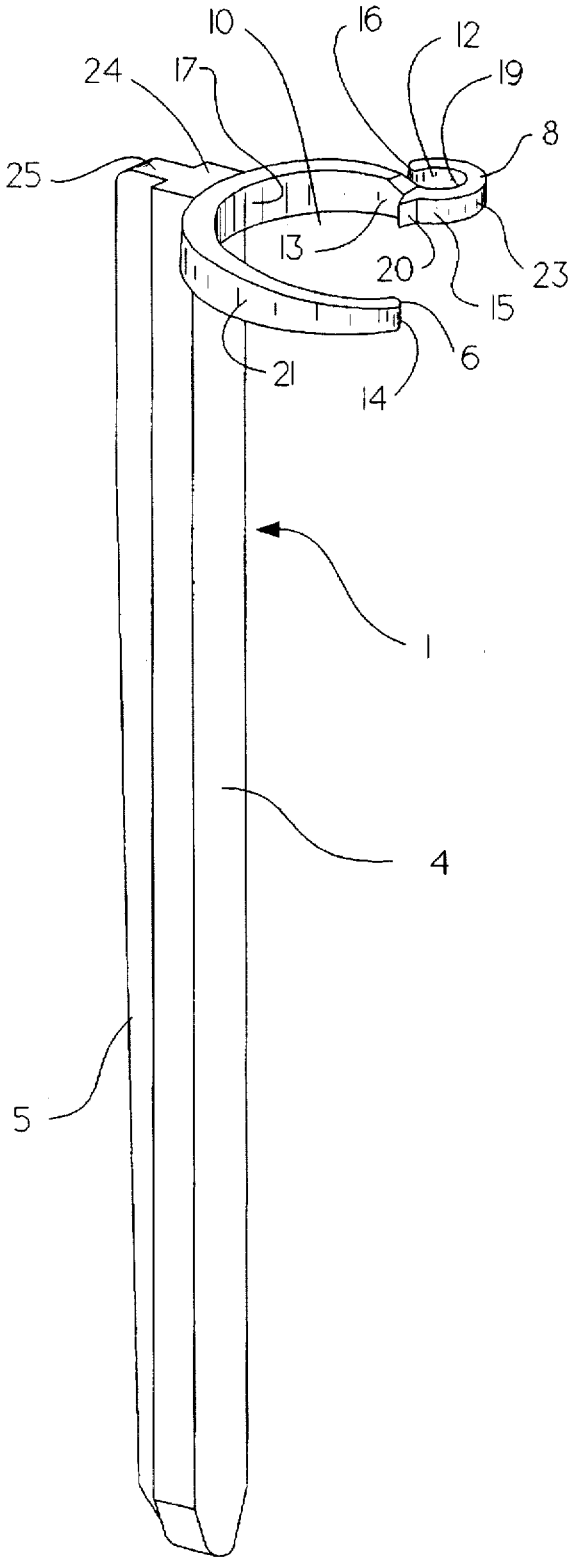
FIG. 1 is a perspective view of a first presently preferred embodiment of my light stake.
Figure 2:
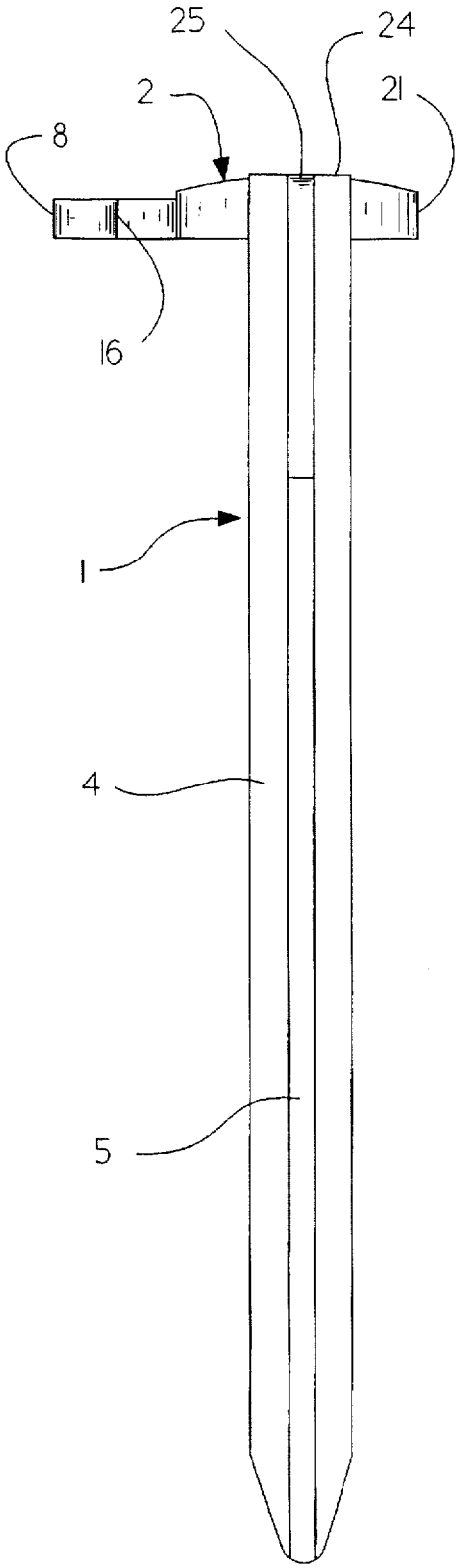
FIG. 2 is a rear elevational view of the embodiment of my light stake shown in FIG. 1.
Figure 3:
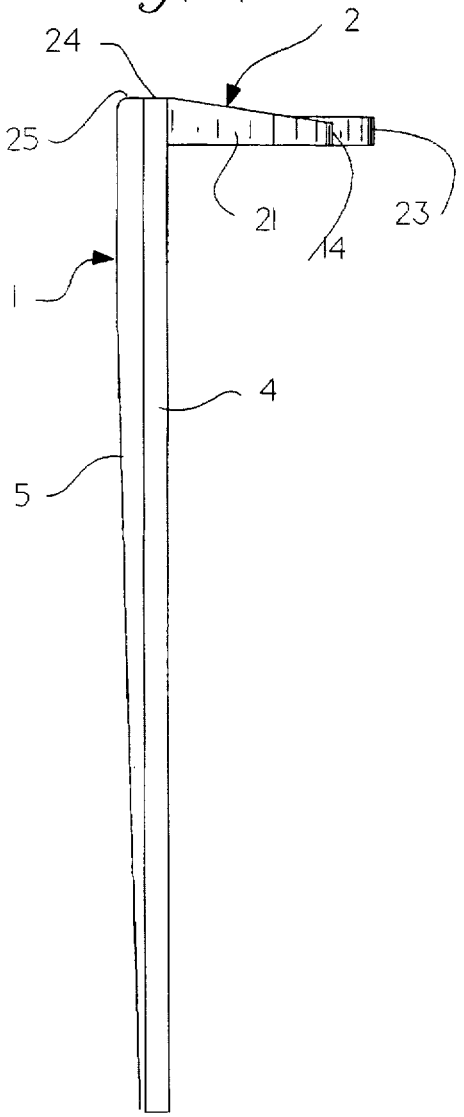
FIG. 3 is a side view thereof.

As shown in FIGS. 1 thru 4, a first presently preferred embodiment of my light stake 1 is substantially comprised of a generally S-shaped, resilient light holder 2 attached to a T-shaped body or stake 4 having a pointed end 7 which in driven into the ground or placed into a hole made with a separate tool. I prefer to provide a reinforcing rib 5 on the rear face of the stake. S-shaped light holder 2 has a first semi-circular gripping member 6 on the left side and a second semi-circular gripping member 8 on the right side. The S-shaped light holder 2 is sized to receive the light sockets of the three presently popular sizes of light sockets. First semi-circular gripping member 6 has a larger opening 10 than the opening 12 in second semi-circular gripping member 8. The light holder is preferably made of polycarbonate or a comparable plastic which permits the distal ends 14 and 16 of the S-shaped holder to be flexed away from the relatively fixed proximate ends 13 and 15 in order that either opening 10 or opening 12 can be enlarged to receive a light socket (not shown). The light holder 2 is preferably tapered such that the height of the gripping members 6 and 8 is smallest at the distal ends thereof. Each gripping member has an interior surface 17 or 19 and an exterior surface 21 or 23. To more securely retain the light sockets a nodule 20 can be placed at the transitions between the interior surface of one gripping member and the exterior surface of the other gripping member. Nodules could also be placed on either or both interior surfaces 17 and 19. If desired a decorative figure or a reflector having a groove can be fitted over the top 24 of the stake 4 or the top 25 of the reinforcing rib 5. An example of a suitable decorative figure is is the angel shown in chain line in FIG. 9.

Figure 5:
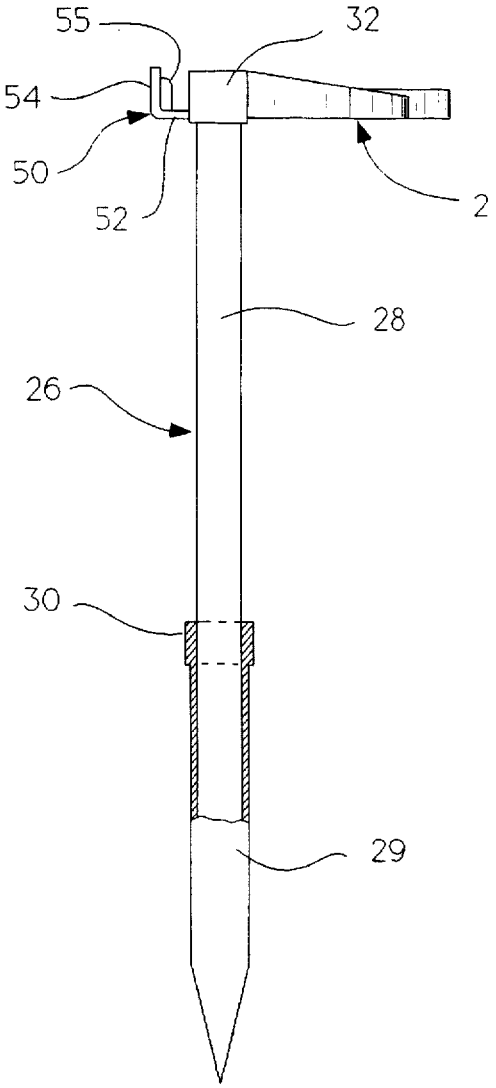
FIG. 5 is an exploded side view of a second presently preferred embodiment of my light stake.
Figure 4:
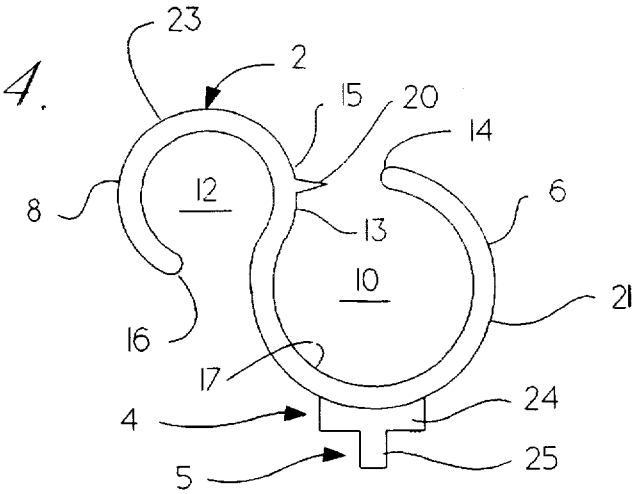
FIG. 4 is a top plan view thereof.
Figure 9:
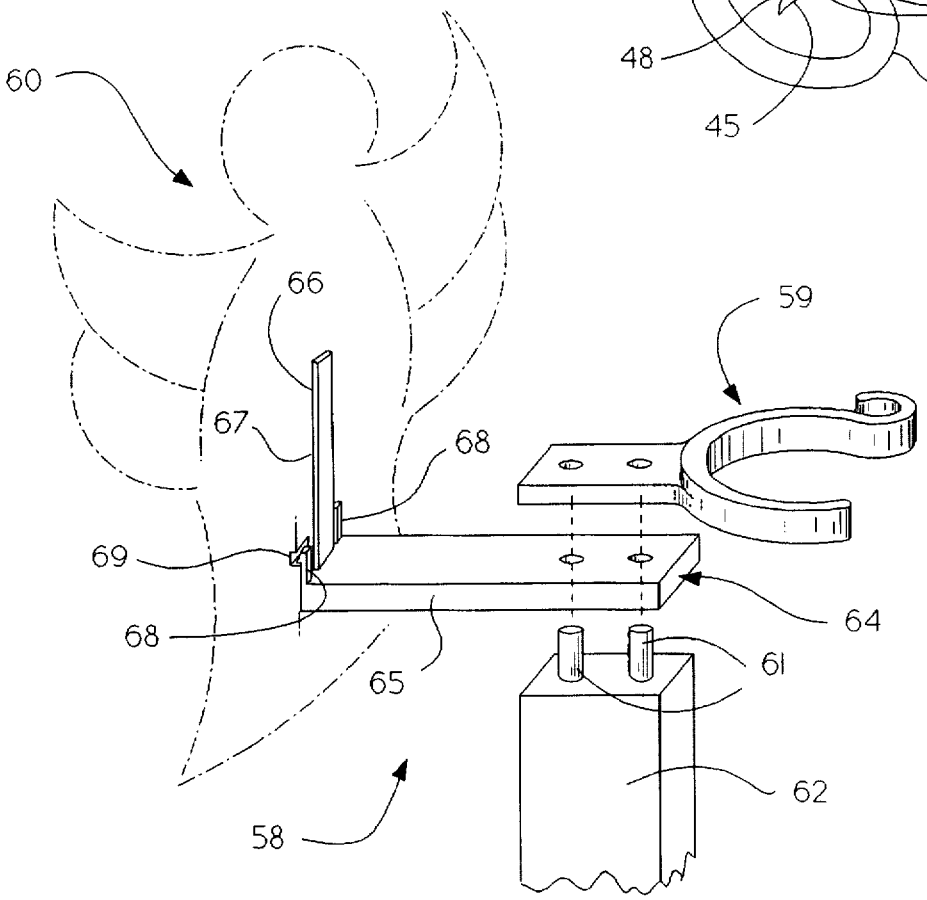
FIG. 9 is a top plan view of a fifth presently preferred embodiment of my light stake.

In a second embodiment shown in FIG. 5 the stake 26 is comprised of an upper portion 28 having a square cross-section to which the light holder 2 is attached and a lower portion 29 having a pointed end which in driven into the ground. The lower portion 29 may be formed of metal or a stronger plastic than is used for the top portion to permit the lower portion to be driven into the ground without breaking. A collar 30 is provided to receive the distal end of the upper portion 28. The light holder 2 is the same configuration as in the first embodiment and also has a tubular mounting portion 32 which fits over the top of the upper portion 28 of the stake. In this embodiment I provide a display holder 50. The display holder has a base 52 and upright portion 54. Upright portion 54 extends from base 52 and may support a removable figure which surrounds the upright. The upright may have a rib 55 on the upright. The figure (not shown) preferably has a slot which mates with the upright of the rib 55. Alternatively, the upright may have a pin or tab which mates with a hole, slot or tab in the decorative figure as illustrated in the embodiment of FIG. 9. This holder may also be used to hold an extension cord or other objects.

Figure 6:
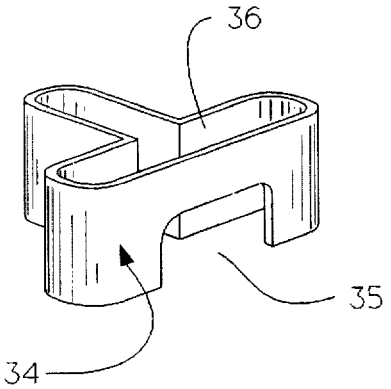
FIG. 6 is a perspective view of a collar which can be used to stack two or more light stakes.

A collar 34 of the type shown in FIG. 6 can be used to stack one light stake on a second light stake. The collar 34 fits over the top of the first light stake so that the cut out 35 surrounds the area where the light holder 2 is attached to the stake 4. The bottom 7 of the second light stake fits into the top of opening 36. The T-shaped configuration of the stake 4 and the opening 36 provide a stable assembly.

Figure 7:
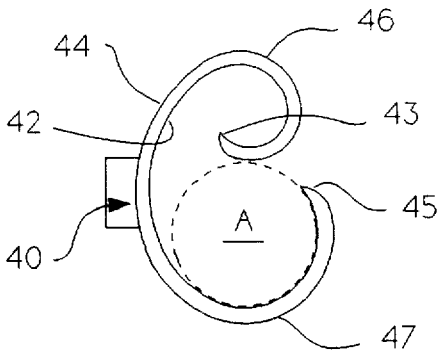
FIG. 7 is a top plan view of a third presently preferred embodiment of my light stake.
Figure 8:
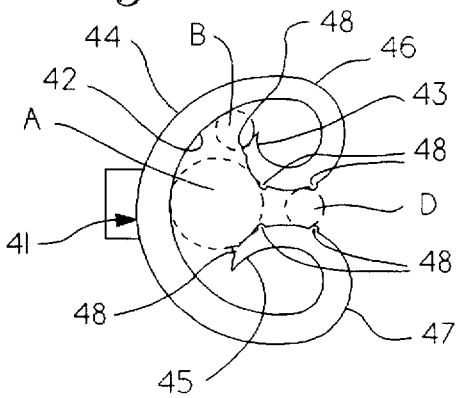
FIG. 8 is a top plan view of a fourth presently preferred embodiment of my light stake.

FIGS. 7 and 8 illustrate an alternate light holder 40 and 41 shaped as a script letter C with at least one end that spirals inward. The script C-shaped light holder 40 or 41 is mounted on a stake 46. The C-shaped light holder 40 or 41 has an interior surface 42, an exterior surface 44, a first end 43, a second end 45, a first curvilinear portion 46 and a second curvilinear portion 47. The script C-shaped light holder 40 or 41 is formed from resilient material such that it can be deformed to grip various size light sockets which are represented in FIGS. 6 and 7 as hidden lines. As shown in FIG. 7, end 45 can be extended such that a large light socket A can be held by curvilinear portion 47.

FIG. 8 illustrates a way in which script C-shaped light holder 41 can retain three light sockets of different sizes. Mini light D can be gripped between exterior surface 44 at first curvilinear portion 46 and exterior surface 44 at second curvilinear portion 47. Further, a large light A can be retained by positioning light A such that exterior surface 44 at first end 43 and exterior surface 44 at second end 45 contact light A and retain light A against interior surface 42. A small light B can be retained such that light B engages interior surface 42 at second curvilinear surface 46 and exterior surface 44 at first end 43. Nodules 48 projecting from exterior surface 44 may be molded into the C-shaped light holder 41 in order to better hold lights A, B and D in position. Although not shown, rounded or angled nodules 48 can be positioned along both exterior surface 44 and interior surface 42.

FIG. 9 illustrates another light stake 58 which can be utilized. An S-shaped light holder 59 similar to that shown in FIGS. 1 thru 4 utilized in combination with a stake 62, display holder 64 and decorative FIG. 60. The display holder 64 and light holder 59 are fitted onto pins 61. The display holder 64 has a base 65 and upright portion 66. Upright portion 66 extends from base 65 and supports a removable FIG. 60 which surrounds the upright and preferably engages a guide edge 67 on the upright or has a pin, tab or hole 69 which mates with a hole, slot or tab 68 on the base 65. Decorative FIG. 60 is shown as a angel but can be in any form such as a showman or star and as well as a reflector. Decorative FIG. 60 is preferably made of a transparent or translucent material so that light emitted from a light (not shown) held in the holder 59 will pass through decorative FIG. 60 and illuminate it. Although light holder 60 is shown behind decorative FIG. 60, display holder 60 could also be positioned so that decorative FIG. 60 would be located behind the light. This would allow passersby to see the light bulb as well as decorative FIG. 60 positioned therebehind. Display holder can be molded integrally with the light holder or stake or can be formed separately and attached to the light holder or the stake.

I prefer to make both the light holder and stake of clear polycarbonate or polypropylene. However, a variety of other plastics or metals could also be used. Further, more than one type of plastic or material can be used in one product. For example, the light holder when formed separate from the stake can be formed of one type of plastic such as polycarbonate, and the stake can be made of polyvinyl chloride.

The light stake may be sold with a tool made of metal or a harder plastic for making a hole into which the bottom of the light stake is inserted. Such a tool would be particularly useful for hard or frozen ground. Moreover, if the manufacturer provides a tool for making a hole into which the light stake is inserted, the stake could be made using less plastic or a lighter weight plastic thereby reducing the cost of the product. The manufacturer may be able to achieve the same advantage by including instructions telling the buyer to use his own tool to make the hole.

Although I have illustrated and described certain presently preferred embodiments of my mounting clip it should be distinctly understood that my invention is not limited thereto, but may be variously embodied within the scope of the following claims.

I claim:

1. A light stake for holding decorative lights comprising:

a. a generally S-shaped light holder defining a left portion having a recess sized to receive a decorative light socket, and a right portion having a second recess sized to receive a second decorative light socket, each portion having an interior surface, an exterior surface, a proximate end and a distal end, the light holder made of resilient material such that the distal end and the proximate end can be sufficiently spread apart so that a decorative light socket can be inserted therebetween and the light holder will grasp the decorative light socket adjacent the interior surface; and b. a stake having a proximate end attached to the generally S-shaped light holder and a distal end suitable for being inserted into a ground surface.

2. The light stake of claim 1 wherein at least one distal end is tapered.

3. The light stake of claim 1 also comprising:

a. a connector fitted over the proximate end of the stake, the connector being sized and configured to receive the distal end of a second stake; and b. a second light stake for holding decorative lights comprising:

i. a second generally S-shaped light holder defining a left portion having a recess sized to receive a decorative light socket, and a right portion having a second recess sized to receive a second decorative light socket, each portion having an interior surface, an exterior surface, a proximate end and a distal end, the light holder made of resilient material such that the distal end and the proximate end can be sufficiently spread apart so that a decorative light socket can be inserted therebetween and the light holder will grasp the decorative light socket adjacent the interior surface; and ii. a second stake having a proximate end attached to the generally S-shaped light holder and a distal end inserted into the connector.

4. The light stake of claim 1 wherein the light holder and the stake are molded to form a one-piece construction.

5. The light stake of claim 1 wherein the light holder is sized to retain common-size decorative lights.

6. The light stake of claim 1 wherein the light holder has at least one nodule on an interior surface.

7. The light stake of claim 1 further comprising a display holder adapted to receive a decorative figure which is sized to fit onto the display holder.

8. The light stake of claim 1 wherein the stake has a T-shaped cross-section.

9. The light stake of claim 1 wherein the stake is comprised of an upper portion, a lower portion and a connector therebetween removably connecting the upper portion to the lower portion.

10. The light stake of claim 1 wherein the lower portion is formed of a harder material than the upper portion.

11. A light stake for holding decorative lights comprising:

a. a generally script C-shaped light holder defining a left portion having a recess sized to receive a decorative light socket, and a right portion having a second recess sized to receive a light socket each portion having an interior surface, an exterior surface, a proximate end and a distal end, the light holder made of resilient material such that the distal end and the proximate end can be sufficiently spread apart so that a decorative light socket can be inserted therebetween and the light holder will grasp the socket adjacent the interior surface;

b. a stake having a proximate end attached to the generally C-shaped light holder and a distal end suitable for being driven into a ground surface; and c. a display holder connected to the stake and adapted to receive a decorative figure which is sized to fit onto the display bolder.

12. The light stake of claim 11 wherein at least one distal end is tapered.

13. The light stake of claim 11 also comprising:

a. a connector fitted over the proximate end of the stake, the connector being sized and configured to receive the distal end of a second stake; and b. a second light stake for holding decorative lights comprising:

i. a generally C-shaped light holder defining a left portion having a recess sized to receive a decorative light socket, and a right portion having a second recess sized to receive a second decorative light socket, each portion having an interior surface, an exterior surface, a proximate end and a distal end, the light holder made of resilient material such that the distal end and the proximate end can be sufficiently spread apart so that a decorative light socket can be inserted therebetween and the light holder will grasp the decorative light socket adjacent the interior surface; and ii. a second stake having a proximate end attached to the generally C-shaped light holder and a distal end inserted into the connector.

14. The light stake of claim 11 wherein the light holder and the stake are molded to form a one-piece, construction.

15. The light stake of claim 11 wherein the light holder is sized to retain all common-size decorative lights.

16. The light stake of claim 11 wherein the light holder has at least one nodule on an interior surface.

17. The light stake of claim 11 wherein the lower portion is formed of a harder material than the upper portion.

18. The light stake of claim 11 wherein the stake has a T-shaped cross-section.

19. The light stake of claim 11 wherein the stake is comprised of an upper portion, a lower portion and a connector therebetween removably connecting the upper portion to the lower portion.

* * * * *